United States Patent [19]

Hadama et al.

[11] Patent Number: 4,573,890

[45] Date of Patent: Mar. 4, 1986

[54] VANE PUMP WITH LOCATING PINS FOR CAM RING

[75] Inventors: Shigeyuki Hadama, Atsugi; Kyoichi Sugizaki, Ebina, both of Japan

[73] Assignee: Atsugi Motor Parts Co., Ltd., Japan

[21] Appl. No.: 663,133

[22] Filed: Oct. 22, 1984

[51] Int. Cl.[4] ..... F04C 2/00; F04C 15/00; B23P 15/00

[52] U.S. Cl. ..... 418/108; 418/133; 418/270; 29/156.4 R

[58] Field of Search ..... 418/1, 107, 108, 133, 418/270; 417/300; 29/156.4 R, 434, 445, 464

[56] References Cited

U.S. PATENT DOCUMENTS

| | | | |
|---|---|---|---|
| 1,722,616 | 7/1929 | Williams | 418/108 |
| 2,733,687 | 2/1956 | Schmid | 418/133 |
| 3,491,699 | 1/1970 | Yowell | 418/133 |
| 4,201,521 | 5/1980 | Carlson | 29/156.4 R |
| 4,470,768 | 9/1984 | Konz | 418/133 |

FOREIGN PATENT DOCUMENTS 59-200085 11/1984 Japan .

*Primary Examiner*—John J. Vrablik
*Attorney, Agent, or Firm*—Lane and Aitken

[57] ABSTRACT

In a vane pump, the cam ring must be fixed to an annular recessed portion of the housing in such a way that there exists no eccentricity between the cam ring and the rotor. To eliminate an eccentricity, a pair of semicircular grooves are formed on the inner circumference of the annular recessed portion diametrically opposed to the center thereof; a pair of semicircular grooves are formed on the outer circumference of the cam ring also diametrically opposed to the center thereof so as to provide two locating pin holes in cooperation with the two housing grooves, respectively; a pair of locating pins are pressure fitted, respectively, to the locating pin holes. Further, it is possible forcibly correct an eccentricity by selecting a locating pin having a diameter appropriately larger than that of the pin hole. The two locating pin holes are arranged in the direction of belt tension to eliminate the eccentricity due to belt tension.

4 Claims, 6 Drawing Figures

VANE PUMP WITH LOCATING PINS FOR CAM RING

BACKGROUND OF THE INVENTION

1. Field of the Invention

The present invention relates to a vane pump, and more particularly to an improvement in assembling a vane pump, in particular, in adjustably fixing a vane pump cam ring to a vane pump housing in such a way that an eccentricity between the cam ring and a rotor can be eliminated.

2. Description of the Prior Art

Vane pumps are incorporated in a power-operated steering system of an automotive vehicle for instance.

A vane pump is roughly made up of a housing, a drive shaft rotatably supported within the housing, a cam ring fixed to an annular recessed portion of the housing, a rotor fixed to the drive shaft and rotatably housed within the cam ring, and a plurality of vanes fitted to slots formed in the rotor so as to be slidably movable in the radial direction of the rotor in contact with the elliptical inner circumferential surface of the cam ring.

In the vane pump as described above, it is necessary to fix the cam ring to the housing under consideration of mutual positional relationship between the two in such a way that the center of the elliptical inner circumferential surface of the cam ring coincides with the center of the rotor; that is, there exists no eccentricity between the two.

In the prior-art method of fixing the cam ring to the housing, a housing pin hole is formed in the radial direction of the housing passed through the cylindrical wall of the housing; a cam ring pin hole is bored in the radial direction of the cam ring at such a position that the housing pin hole matches the cam ring pin hole, and a single locating pin is pressure-fitted into these two pin holes to fix the cam ring to the housing. In the prior-art method as described above, however, although the cam ring can be fixed to the annular recessed portion of the housing, since only a single locating pin is fitted to a single pair of pin holes, it is impossible to fix the cam ring to the housing with a center of the cam ring accurately located at a center of the rotor where there exist dimensional errors in these elements, and further it is impossible to adjust the mutual relationship between the cam ring and the rotor or to correct an eccentricity between the two elements. In case there exists an eccentricity between these two elements, the outer circumferential surface of the rotor may be brought into contact with the elliptical inner circumferential surface of the cam ring, thus resulting in abnormal wear or short service time and abnormal vibrations or loud mechanical noise.

To overcome the above drawbacks, a method of selective assembly has been adopted, in which the dimensions of the two elements are measured and a set of two elements having counterbalanced dimensional errors are selected for assembling each vane pump. However, this method requires much time, thus lowering the work efficiency.

Further, since a tension is always applied to the rotor by a drive belt engaged with a vane pump pulley, when the vane pump is in operation, there inevitably exists an eccentricity between the rotor and the cam ring in spite of the fact that the vane pump is assembled in accordance with the method of selective assembly.

The arrangement of the prior-art vane pump will be described in more detail hereinafter with reference to the attached drawings under DETAILED DESCRIPTION OF THE PREFERRED EMBODIMENTS.

SUMMARY OF THE INVENTION

With these problems in mind, therefore, it is the primary object of the present invention to provide a vane pump in which the cam ring can securely be fixed to the housing in such a way that a cam ring center is accurately located at a rotor center without producing an eccentricity between the two.

It is the other object of the present invention is to provide a vane pump in which the cam ring can adjustably be fixed to the housing in such a way that the cam ring can be shifted a little in the radial direction thereof with respect to the housing so as to eliminate an eccentricity existing between the cam ring and the rotor.

To achieve the above-mentioned first object, the vane pump according to the present invention comprises (a) a pair of semicircular housing grooves formed on the inner circumferential surface of the annular recessed portion of the housing and in the axial direction of the housing, said two semicircular housing grooves being located diametrically opposed to the center of the recessed portion; (b) a pair of semicircular cam ring grooves formed on the outer circumferential surface of the cam ring and in the axial direction of the housing, said two semicircular cam ring grooves being located diametrically opposed to the center of the cam ring in such a way as to provide two locating pin holes in cooperation with said two semicircular housing grooves, respectively; and (c) a pair of locating pins pressure-fitted, respectively, to said locating pin holes formed by said two semicircular housing grooves and said two semicircular cam ring grooves in order to fix the cam ring to the housing.

To achieve the other object of the present invention, in the vane pump according to the present invention, one locating pin having an appropriate diameter greater than that of said locating pin hole is previously selected according to the magnitude of eccentricity between the rotor and cam ring developed at positions where said two locating pin holes are formed, and is pressure fitted to one locating pin hole so as to forcibly eliminate the developed eccentricity, a diameter of the other locating pin being substantially equal to that of said locating pin holes.

BRIEF DESCRIPTION OF THE DRAWINGS

The feature and advantages of the vane pump according to the present invention over the prior art vane pump will be more clearly appreciated from the following description of the preferred embodiment of the invention taken in conjunction with the accompanying drawings in which like reference numerals designate the same or similar elements throughout the figures thereof and in which.

DETAILED DESCRIPTION OF THE PREFERRED EMBODIMENTS

To facilitate understanding of the present invention, a reference will be made to a prior-art vane pump, with reference to the attached drawings.

Figure 1:
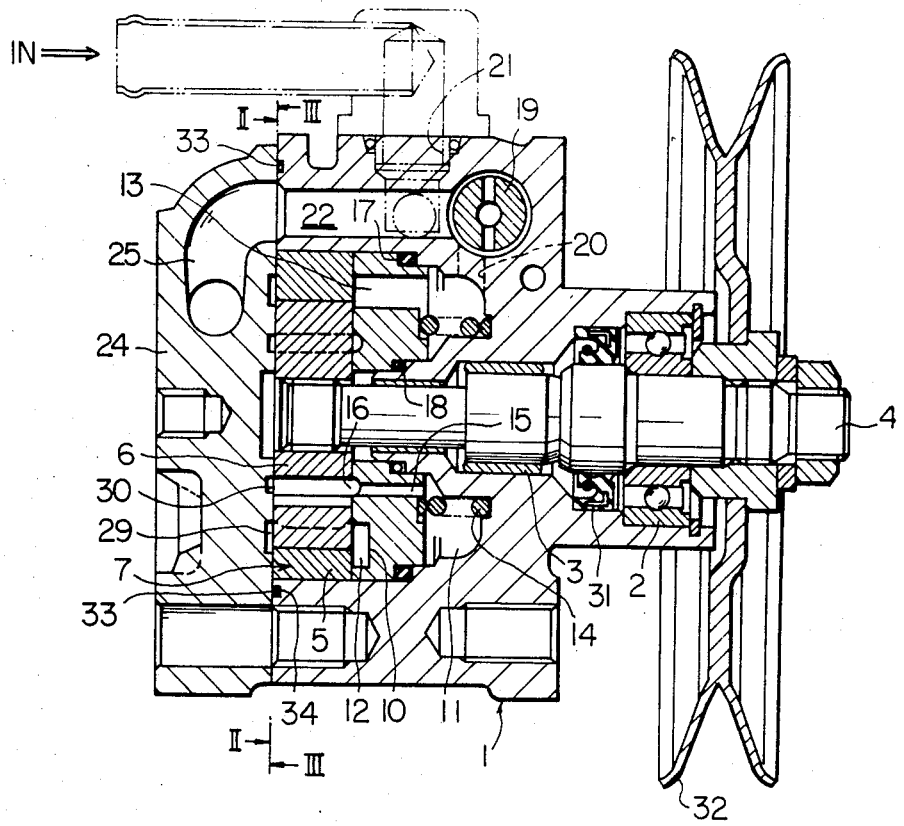
FIG. 1 PRIOR ART
FIG. 1 is a cross-sectional view of an example of a prior-art vane pump, taken along the line I—I shown in FIG. 2.
Figure 2:
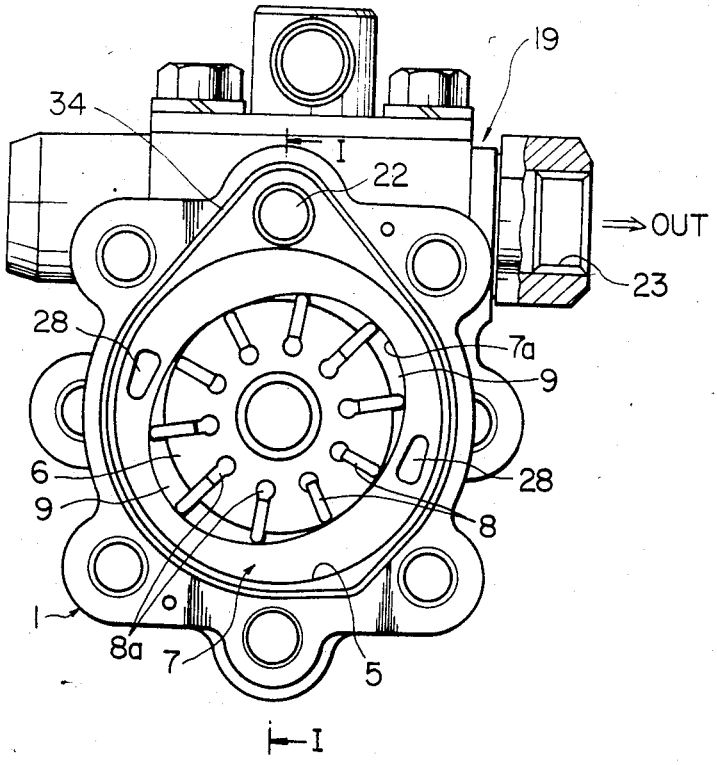
FIG. 2 PRIOR ART
FIG. 2 is a side view of the prior-art vane pump shown in FIG. 1, when separated at the line II—II shown in FIG. 1 and seen from the arrow shown in FIG. 1.
Figure 3:
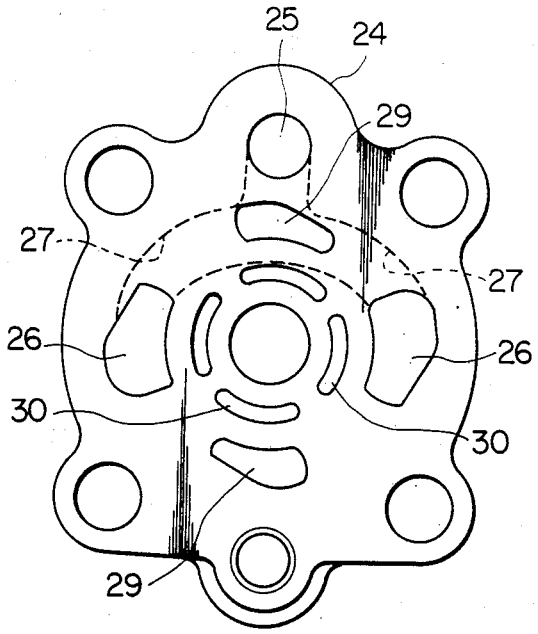
FIG. 3 PRIOR ART
FIG. 3 is a side view of the prior-art vane pump shown in FIG. 1, when separated at the line III—III shown in FIG. 1 and seen from the arrow shown in FIG. 1.

FIGS. 1 to 3 show an example of the structure of prior-art vane pump. In the drawings, the reference numeral 1 denotes a housing in which a ball bearing 2 and a bush bearing 3 are arranged for rotatably supporting a drive shaft 4. The housing 1 is formed with an annular recessed portion 5 on one side surface thereof. Within this annular recessed portion 5, a rotor 6 and a cam ring 7 are both housed. The rotor 6 is fixed to the drive shaft 4 by means of splines and rotatably disposed within the cam ring 7. Further, the rotor 6 is provided with a plurality of vanes 8 (shown in FIG. 2). The vanes 8 can freely slide in the radial direction of the rotor 6. The end of each vane 8 is in slide-contact with the elliptical inner circumferential surface 7*a* (shown in FIG. 2) of the cam ring 7. A plurality of working fluid chambers 9 (shown in FIG. 2) are formed between two adjacent vanes 8. The volume of each working fluid chamber 9 is increased or decreased or vice versa as the rotor 6 rotates because each vane 8 is slidably moved radially in close contact with the inner circumferential surface 7*a* of the cam ring 7. When the volume of each working fluid chamber 9 is increased, hydraulic working fluid is absorbed and charged into the chamber 9; when the volume of each working fluid chamber 9 is decreased, hydraulic working fluid is compressed and discharged. As better seen in FIG. 2, two fluid charging regions and two fluid discharging regions are formed between the rotor 6 and the cam ring 7 radially symmetrically with respect to the cam ring 7.

The reference numeral 10 denotes a side plate. This side plate 10 is disposed within the annular recessed portion 5 of the housing 1 in such a way as to be urged toward the inner end surface of the cam ring 7 by means of a spring 14. A high-pressure chamber 11 for discharging compressed working fluid is formd between the bottom end surface of the annular recessed portion 5 and the inner end surface of the side plate 10. In this side plate 10, there are formed a discharge port 12 so arranged as to communicate with the fluid discharge regions formed between the rotor 6 and the cam ring 7 and a dischrge passage 13 communicating with the discharge port 12. The total amount of compressed working fluid is once introduced into the high-pressure chamber 11 through the discharge passage 13. Therefore, the side plate 10 is brought into pressure contact with the cam ring 7 by the pressure of compressed and discharged working fluid from the side of the high-pressure chamber 11 in addition to an elastic force of the above-mentioned spring 14 disposed within the high-pressure chamber 11. The urged side plate 10 can tightly hold working fluid within the working fluid chambers 9.

Further, a plurality of through holes 15 and a plurality of arcuate grooves 16 are formed in the side plate 10. The arcuate grooves 16 are formed on the outer end surface of the side plate 10, which is in pressure contact with the rotor 6. Therefore, part of working fluid within the high-pressure chamber 11 is introduced from the high pressure chamber 11 to the base end portions of the vane slots 8*a* formed in the rotor 6 through these through holes 15 and the arcuate grooves 16, in order to urge each vane 8 in the radial direction of the rotor 6. Further, the reference numerals 17 and 18 denote seal rings each for tightly sealing gaps between the side plate 10 and the housing 1, that is, the high-pressure chamber 11.

The reference numeral 19 denotes a fluid flow control valve disposed between a high pressure passage 20 and a low pressure passage 22. The high-pressure passage 20 communicates with the high-pressure chamber 11 and the low-pressure passage 22 communicates with an inlet port 21 of the vane pump. This fluid flow control valve 19 serves to control or adjust the amount of working fluid discharged from an outlet port 23 of the vane pump. In other words, when this control valve 19 is rotated for adjustment, it is possible to return an excessive working fluid within the high-pressure chamber 11 from the high-pressure passage 20 to the low-pressure passage 22.

The reference numeral 24 denotes a cover plate for closing the opened outer end surface of the housing 1 by the aid of bolts (not shown). The cover plate 24 is formed with various passages 25 and 27, intermediate ports 26, and grooves 30. With reference to FIGS. 1 and 3, these passages, intermediate ports and grooves are explained in more detail hereinbelow.

The inlet passage 25 communicates with the low-pressure passage 22. The branched passages 27 are formed being branched from the inlet passage 25 and communicates with the right and left intermediate ports 26. These two intermediate ports 26 communicates with the fluid charge regions of the working fluid chambers 9. A part of these two intermediate ports 26 communicates with two through holes 28 (shown in FIG. 2) formed in the cam ring 7, respectively. These through holes 28 communicate with other intermediate ports (not shown) recessed in the side plate 10. These through holes 28 serve to introduce working fluid to both the sides of the working fluid chambers 9, thus improving fluid charging or absorbing function or performance. Further, four arcuate grooves 30 are formed on the inner end surface of the cover plate 24 which is in contact with the rotor 6, at such positions that these arcuate grooves 30 match the arcuate grooves 16 formed on the outer end surface of the side plate 10.

Further, two discharge ports 29 are formed on the inner end surface of the cover plate 24, at such positions that these discharge ports 29 match the discharge ports 12 formed on the outer end surface of the side plate 10.

The outer peripheral shape of the cover plate 10 matches that of the housing 1 at junction portions.

Further, in FIG. 1, the reference numeral 31 denotes an annular seal for sealing between the housing 1 and the drive shaft 4; the numeral 32 denotes a pulley fixed to the drive shaft 4 by means of splines; the numeral 33 denotes a seal ring disposed between the end surfaces of the housing 1 and the cover plate 10 on the outer side from the annular recessed portion 5 and the low-pressure passage 22. This seal ring 33 is fitted to a seal groove 34 formed on the end surface of the housing 1 in order to prevent working fluid from leaking from the vane pump.

In the vane pump thus constructed, when the pulley 32 is driven by an engine, for instance, the power is transmitted to the rotor 6 through the drive shaft 4. When the rotor 6 rotates, working fluid reserved in a reservoir (not shown) is introduced into the working fluid chambers 9 formed between the rotor 6 and the cam ring 7 by way of inlet port 21, the low-pressure passage 22, the inlet passage 25, the branched passages 27, and the intermediate ports 26. The introduced and then compressed working fluid is discharged from the working fluid chambers 9 to the outlet port 23 of the vane pump by way of the discharge ports 12 and 29, the discharge passage 13, the high-pressure chamber 11, the high-pressure passage 20, and the fluid flow control value 19.

By the way, in such a vane pump as described above, it is necessary to fix the cam ring 7 to the housing 1 under a predetermined mutual positional relationship. The reason is as follows: The inner hollow portion of the cam ring 7 is elliptic in shape and thereby the two working fluid chambers 9 will be formed in the direction of the major axis of the elliptical hollow portion of the cam ring; and the discharge passage 13 (shown in FIG. 1) formed in the side plate 10 should communicate with one of the working fluid chambers 9.

Additionally, it is necessary to fix the cam ring 7 to the housing 1 in such a way that the center of the inner elliptical hollow portion of the cam ring 7 coincides with the center of the rotor 6; that is, there exists no eccentricity between the cam ring 7 and the rotor 6. Otherwise, the outer surface of the rotating rotor 6 may be brought into contact with the inner circumferential surface of the cam ring 7, thus resulting in abnormal wear, abnormal vibration, and/or abnormal mechanical noise.

Figure 4:
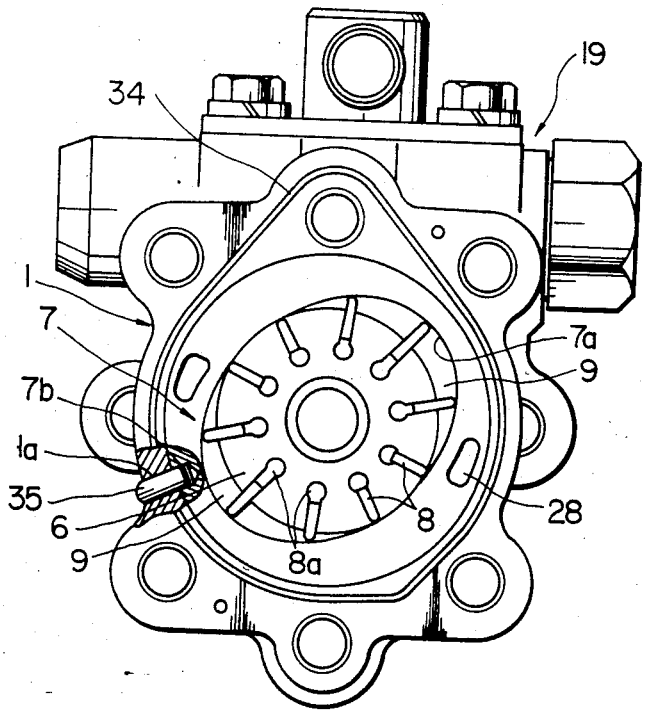
FIG. 4 PRIOR ART
FIG. 4 is a side view, partly in cross sectional and broken view of the prior-art vane pump similar to FIG. 2.

With reference to FIG. 4, the conventional method of fixing the cam ring 7 to the housing 1 is described hereinbelow. A housing pin hole 1*a* is formed in the radial direction of the housing 1 being passed through the cylindrical wall of the housing. Further, a cam ring pin hole 7*b* is bored in the radial direction of the cam ring 7. The two pin holes 1*a* and 7*a* match each other at a position where the cam ring 6 should be fixed to the housing 1. A locating pin 35 is pressure-fitted to these two pin holes 1*a* and 7*b* for securely fixing the cam ring 7 to the housing 1.

In the prior-art method of fixing the cam ring 7 to the housing 1, however, there exist some drawbacks. The basic problems are:

(1) When fixing the cam ring 7 to the housing in assembling process, it is very difficult to fix the cam ring 7 concentrically with respect to the center of the rotor 6, that is, to eliminate an eccentricity between the cam ring 7 and the rotor 6. This is because each element such as housing 1, rotor 6, cam ring 7, etc. will not be manufactured perfectly accurate; in other words, each element is manufactured having dimensional errors, which are allowed on the basis of acceptable limits. Therefore, when a vane pump is assembled by the use of these elements having different dimensions, these dimensional errors sometimes exert a harmful synergistic influence upon the assembled elements. In other words, in some cases, there exists a great degree of eccentricity between the centers of the rotor 6 and the cam ring. In the prior-art method, since only a single locating pin 35 is pressure-fitted to the pin holes 1*a* and 7*b*, it is very difficult to fix the cam ring 7 to the housing concentrically with respect to the center of the rotor 6.

In case of the cam ring 7 is fixed to the housing 1 eccentrically with respect to the center of the rotor 7, the center of the elliptical inner circumferential surface 7*a* of the cam ring 7 is biased, thus resulting in a problem that the rotating rotor 6 is locally brought into contact with this inner circumferential surface 7*a*. The above-mentioned contact of two elements causes abnormal wear or short service time, and abnormal vibrations or loud mechanical noise.

(2) In order to eliminate the above-mentioned drawbacks, that is, an eccentricity of the rotor 6 and the cam ring 7 due to dimensional errors, conventionally selective assembly method has been adopted, in which the outer diameter of the rotor 6 and the minor axial length of the hollow portion of the cam ring 7 are measured independently and two elements are selectively assembled so as to cancel the dimensional errors each other.

The above selective assembling work is effective; however, it takes much time to assemble the vane pump, thus deteriorating the work efficiency.

(3) Since a tension is always applied to the drive shaft 4, to which the rotor 6 is fixed, by a drive belt (not shown) engaged with the pulley 32 and further since there exist clearances between the drive shaft 4 and bearings 2 and 3, the drive shaft 4 and the rotor 6 fixed to the drive shaft 4 tend to be dislocated from the central position in the direction of pulley tension, thus causing an eccentricity between the rotor 6 and the cam ring 7.

(4) In order to eliminate the above-mentioned drawbacks (3), that is, an eccentricity between the rotor 6 and the cam ring 7 due to belt tension, it is possible to previously dislocate the center of the cam ring 7 in the direction that the belt tension is applied. However, it is very troublesome to previously dislocate the cam ring 7 with respect to the center of the rotor 6. In other words, it takes much time in assembling the vane pump. Moreover, since the direction that a belt tension is applied changes according to the types of automotive vehicles, it is rather impossible to previously dislocate the cam ring 7 appropriately under the consideration of the magnitude and the direction of an eccentricity according to the types of vehicles on which the vane pump is mounted.

In view of the above description, reference is now made to an embodiment of the vane pump according to the present invention, with reference to the attached drawings.

Figure 5:
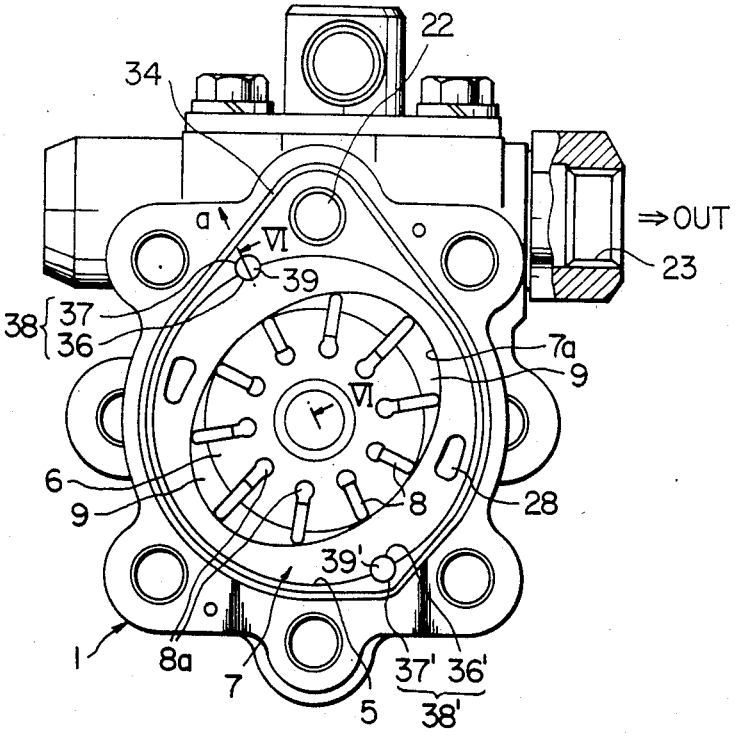
FIG. 5 is a side view of the vane pump according to the present invention similar to FIG. 2.
Figure 6:
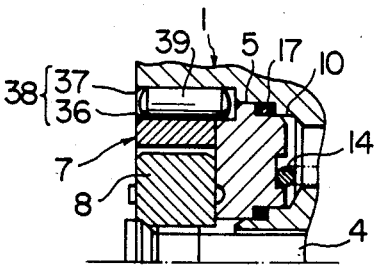
FIG. 6 is a partial cross-sectional view taken along the line VI—VI shown in FIG. 5.

With reference to FIGS. 5 and 6, the method of fixing the cam ring 7 to the housing 1 is described hereinbelow.

A pair of semicircular cam ring grooves 36 and 36' are formed in the outer circumferential surface of the cam ring 7 being located diametrically opposed to the center of the cam ring.

Further, a pair of semicircular housing grooves 37 and 37' are formed in the inner circumferential surface of the housing 1 being located diametrically opposed to the center of the annular recessed portion 5 of the housing 1.

These two pairs of semicircular grooves 36, 36' and 37 and 37' are formed in the axial direction of the housing 1 and so arranged as to provide two separate pin holes 38 and 38', respectively. Into these two separate holes 38 and 38', two separate locating pins 39 and 39' are pressure fitted, independently. These two locating pins 39 and 39' serve to adjustably fix the cam ring 7 to the housing 1; that is, it is possible to adjust the position of the cam ring 7 with respect to the rotor 6, in addition to fixing of the cam ring 7 to the housing 1.

In more detail, first the cam ring 7 is inserted into the annular recessed portion 5 of the housing 1. Next, the clearance between the elliptical inner circumferential surface *7a* of the cam ring 7 and the outer circumferential surface of the rotor 6 is checked. In this case, assumption is made that the inner cam ring 7 is a little dislocated in the direction of arrow a shown in FIG. 5; that is, there exists an eccentricity between the rotor 6 and the cam ring 7. In case the cam ring 7 is fixed to the housing 1 as they are, the clearance between the rotor 6 and the cam ring 7 is excessive near the locating pin hole 38 but too little near the locating pin hole 38', so that the rotor 6 may be brought into contact with the cam ring 7 near the locating pin hole 38' and thereby there exists a possibility of abnormal wear. In such a case as described above, a locating pin 39 having an appropriate diameter larger than that of the locating pin hole 38 is selected from among a number of locating pins having different diameters, respectively, larger than that of the pin hole 38. These adjusting pins are previously prepared being classified by the dimensions of pin diameter. A locating pin having an appropriate diameter is selected according to the magnitude of clearance near the pin hole 38.

Therefore, when the selected pin 39 is pressure fitted to the locating pin hole 38, the cam ring 5 is forcibly a little shifted, in the direction opposite to a shown in FIG. 5, that is, in the direction that the clearance near the pin hole 38 is reduced, to a position where the center of the rotor 6 matches the center of the elliptical inner circumferential surface *7a* of the cam ring 7. Simultaneously, the cam ring 7 is fixed to the housing 1. Further, after the locating pin 39 has been inserted into the pin hole 38, another locating pin 39'having a standard diameter substantially equal to the locating pin hole 38' is pressure fitted to the pin hole 38'.

In contrast with this, in the case where the elliptical inner circumferential cam surface *7a* is a little dislocated in the direction opposite to arrow a shown in FIG. 5, the clearance between the rotor 6 and the cam ring 7 is excessive near the locating pin hole 38' but too little near the locating pin hole 38. In such a case as described above, a locating pin 39' having an appropriate diameter larger than that of the locating pin hole 39 is selected and pressure fitted to the locating pin hole 38'. Therefore, the cam ring 5 is forcibly a little shifted in the direction of arrow a shown in FIG. 5, that is, in the direction that the clearance near the pin hole 38' is reduced, to a position where the center of the rotor 6 matches the center of the elliptical inner circumferential surface *7a* of the cam ring 7. Simultaneously, the cam ring 7 is fixed to the housing 1. Further, after the locating pin 39' has been inserted into the pin hole 38', a locating pin 39 having a standard diameter substantially equal to the locating pin hole 38 is pressure fitted to the pin hole 38.

As described above, in the vane pump according to the present invention which includes a housing, a cam ring housed in an annular recessed portion of the housing, a rotor rotatably supported in the cam ring and having a plurality of vanes fitted to the slots of the rotor in such a way as to be slidably movable in the radial direction of the rotor, since the cam ring is adjustably fixed to the housing in such a way that (a) a pair of semicircular grooves are formed in the inner circumference of the annular recessed portion of the housing at positions diametrically opposed to the center of the recessed portion; (b) a pair of semicircular grooves are formed in the outer circumference of the cam ring at positions diametrically opposed to the center of the cam ring in such a way as to provide two pin holes; (c) a locating pin having an appropriate diameter larger the diameter of the pin hole is selected according to the eccentricity between the rotor and the cam ring, and is then pressure-fitted to one of the two pin holes in such a way as to forcibly correct an eccentricity; and (d) another locating pin having a standard diameter substantially equal to the diameter of the pin hole is fitted to the other of the two pin holes, there exist the following features and effects:

(1) It is possible to correct the eccentricity between the rotor and the cam ring by a simplified assembly work such that locating pins having an appropriate diameter, respectively, are selected and pressure fitted to the pin holes.

(2) In the case where the direction of the belt engaged with the pulley to drive the rotor is previously determined, it is possible to previously determine an eccentricity between the rotor and the cam ring on the basis of some experiments. Therefore, the eccentricity can be cancelled by the tension of the belt provided that the two positions of the locating holes are arranged in line with the direction of the belt tension.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. A vane pump having:

a housing;

a cam ring fixedly housed in an annular recessed portion of the housing;

a rotor rotatably supported within the cam ring; and a plurality of vanes fitted to slots formed in the rotor in such a way as to be slidably movable in the radial direction of the rotor in contact with the elliptical inner circumferential surface of the cam ring, wherein the improvement which comprises:

(a) a pair of semicircular housing grooves formed on the inner circumferential surface of the annular recessed portion of the housing and in the axial direction of the housing, said two semicircular housing grooves being located diametrically opposed to the center of the recessed portion;

(b) a pair of semicircular cam ring grooves formed on the outer circumferential surface of the cam ring and in the axial direction of the housing, said two semicircular cam ring grooves being located diametrically opposed to the center of the cam ring in such a way as to provide two locating pin holes in cooperation with said two semicircular housing grooves, respectively; and (c) a pair of locating pins pressure-fitted, respectively, to said locating pin holes formed by said two semicircular housing grooves and said two semicircular cam ring grooves in order to forcibly eliminate a developed eccentricity between the housing and the cam ring, one locating pin having an appropriate diameter greater than that of the locating pin holes being previously selected according to the eccentricity developed at positions where the two locating pin holes are formed, a diameter of the other locating pin being substantially equal to that of the other locating pin holes.

2. The vane pump as set forth in claim 1, wherein said vane pump is adapted to have a predetermined belt tension applied to said rotor in a predetermined direction and wherein said two locating pins holes are arranged, respectively, diametrically opposed to the center of the cam ring or the housing in said predetermined direction and one locating pin with an appropriate diameter greater than that of the locating pin hole is previously selected according to a magnitude of said belt tension so as to eliminate an estimated eccentricity between the rotor and the cam ring due to said belt tension applied to the vane pump.

3. A method of fixing a cam ring to a housing in an annular recessed portion of said housing in a vane pump having:

a rotor rotatably supported within the cam ring; and a plurality of vanes fitted to slots formed in the rotor in such a way as to be slidably movable in the radial direction of the rotor in contrast with the elliptical inner circumferential surface of the cam ring, comprising the following steps of:

(a) forming a pair of semicircular housing grooves on the inner circumferential surface of the annular recessed portion of the housing and in the axial direction of the housing at two positions diametrically opposed to the center of the annular recessed portion;

(b) forming a pair of semicircular cam ring grooves on the outer circumferential surface of the cam ring and in the axial direction of the housing at two positions diametrically opposed to the center of the cam ring so as to provide two locating pin holes in cooperation with the two semicircular housing grooves, respectively; and (c) checking an eccentricity between the rotor and the cam ring at positions where the two locating pin holes are formed;

(d) selecting one locating pin with an appropriate diameter greater than that of the locating pin hole from among a number of locating pins having different diameters on the basis of the checked eccentricity;

(e) pressure-fitting the selected locating pin to one of the locating pin holes so as to forcibly eliminate the checked eccentricity; and (f) pressure-fitting a locating pin having a diameter substantially equal to that of the locating pin holes to the other of the locating pin hole.

4. The method of fixing the cam ring to the housing as set forth in claim 3, wherein the two locating pin holes are formed, respectively, diametrically opposed to the center of the cam ring or the housing in a predetermined direction that a belt tension is to be applied to the rotor and one locating pin with an appropriate diameter greater than that of the locating pin hole is previously selected according to the magnitude of the belt tension so as to eliminate an estimated eccentricity between the rotor and the cam ring due to a belt tension applied to the vane pump, and wherein the method further comprises installing said vane pump so that said belt tension is applied to said rotor in said predetermined direction.

* * * * *